United States Patent [19]

Nakano et al.

[11] 4,389,997

[45] Jun. 28, 1983

[54] ELECTRONICALLY CONTROLLED METHOD AND APPARATUS FOR VARYING THE AMOUNT OF FUEL INJECTED INTO AN INTERNAL COMBUSTION ENGINE WITH ACCELERATION PEDAL MOVEMENT AND ENGINE TEMPERATURE

[75] Inventors: Jiro Nakano; Hideo Miyagi, both of Okazaki, Japan

[73] Assignee: Toyota Jidosha Kogyo Kabushiki Kaisha, Toyota, Japan

[21] Appl. No.: 171,031

[22] Filed: Jul. 22, 1980

[30] Foreign Application Priority Data

Apr. 28, 1980 [JP] Japan ..... 55-55415

[51] Int. Cl.[3] ..... F02B 3/00

[52] U.S. Cl. ..... 123/492; 123/489; 123/478

[58] Field of Search ..... 123/478, 492, 491, 493, 123/480, 489, 505

[56] References Cited

U.S. PATENT DOCUMENTS

| | | | |
|---|---|---|---|
| 3,593,692 | 7/1971 | Scholl et al. | 123/492 |
| 3,673,989 | 7/1972 | Aono et al. | 123/492 |
| 3,858,561 | 1/1975 | Aono | 123/492 |
| 3,983,851 | 10/1976 | Hoshi | 123/492 |
| 4,127,086 | 11/1978 | Harada et al. | 123/493 |
| 4,159,697 | 7/1979 | Sweet | 123/492 |
| 4,227,507 | 10/1980 | Takase et al. | 123/492 |

*Primary Examiner*—P. S. Lall

*Attorney, Agent, or Firm*—Cushman, Darby & Cushman

[57] ABSTRACT

Electric signals produced in association with both a speed of movement of an acceleration pedal and an engine temperature are transmitted to a fuel injection valve in an intake system asynchronously with the running of an engine, so that an amount of fuel being injected from the fuel injection valve is increased as the speed of movement of the acceleration pedal increases and as the engine temperature is lowered. As a result, fuel is injected at a proper rate according to both the acceleration required and the engine temperature, the driving feeling during acceleration as well as a fuel consumption rate are improved, and an amount of detrimental components in the exhaust gases is lowered.

30 Claims, 7 Drawing Figures

ELECTRONICALLY CONTROLLED METHOD AND APPARATUS FOR VARYING THE AMOUNT OF FUEL INJECTED INTO AN INTERNAL COMBUSTION ENGINE WITH ACCELERATION PEDAL MOVEMENT AND ENGINE TEMPERATURE

BACKGROUND OF THE INVENTION

1. Field of the Invention

This invention relates to an electronically controlled, fuel injection method of and apparatus for for internal combustion engines, wherein a fuel injection valve for injecting a fuel into an intake system of an internal combustion engine is controlled by electric signals.

2. Description of the Prior Arts

In a conventional, electronically controlled, fuel injection method, an amount of fuel being injected into an intake system during acceleration is controlled by injecting the fuel at a given rate from the injection valve as soon as it is sensed that a throttle valve has been opened from the fully close position, or every time a switching means is turned to the on-position which switching means is adapted to be turned on and off alternately in association with the openning movement of the throttle valve. In the former, a given amount of fuel can be successfully supplied into the combustion chambers, irrespective of the acceleration required. Yet, the former is attended with such drawbacks as when a slow acceleration is required, an overrich mixture charge results, thus lowering the fuel consumption efficiency, and increasing an amount of detrimental components the exhaust gases; when a rapid acceleration is required or acceleration is conducted in a state in which the throttle valve assumes a given position except the fully close position, the amount of fuel being supplied is lessened, lowering the driving feeling during acceleration. In the latter, an amount of fuel being injected for acceleration is determined independently of the acceleration required, resulting in the drawbacks as encountered with the former method.

SUMMARY OF THE INVENTION

In an attempt to eliminate the above-described drawbacks, it is an object of the present invention to provide an electronically controlled, fuel injection method and apparatus wherein a fuel consumption efficiency during acceleration as well as a driving feeling are improved, and production of detrimental components is suppressed.

To attain the above-described object, there is provided according to the present invention an electronically controlled fuel injection method and apparatus, wherein electric signals produced in association with both a speed of movement of an acceleration pedal and an engine temperature are transmitted to a fuel injection valve asynchronously with the running of an engine, so that a rate of fuel being injected from the fuel injection valve can increases, with increase in the speed of movement of the acceleration pedal and the lowering of the engine temperature.

With an increase in the acceleration required and with the lowering of the engine temperature, or stated otherwise, if the running of an engine is stable, then the mixture charge becomes excessively rich. Based on the above fact, fuel can be injected at an optimum rate, in association with the acceleration required and the engine temperature, thus improving the fuel consumption efficiency during acceleration and the driving feeling, as well as suppressing the production of detrimental components in the exhaust gases.

In more detail, an injection valve electric signal generated in association with both a speed of movement of an acceleration pedal and an engine temperature and an injection valve electric signal generated in association with a flow rate of intake air are summed for transmission to the fuel injection valve. The injection-valve electric signal generated in association with the flow rate of intake air is transmitted to the fuel injection valve in synchronism with the running of an engine, and on the other hand, the acceleration electric signal according to the present invention is transmitted to the fuel injection valve asynchronously with the running of the engine, with the result of the improved response during acceleration.

The speed of movement of the acceleration pedal is detected from a variation in the opening of the throttle valve in the intake system which is interconnected to the acceleration pedal. A sensor for detecting a variation in the opening of the throttle valve comprises; a pair of toothed conductors arranged with the teeth of one conductor staggered with and at a given spacing from the teeth of the other conductor; a contact portion adapted to move in contact with the teeth of the pair of toothed conductors in association with the movement of the throttle valve; and a switch adapted to connect the contact portion to the ground terminal only when the opening of the throttle valve is increased. The pair of toothed conductors are repeatedly connected to ground in association with the movement to the open position of the throttle valve, so that pulses representing a moving speed of the throttle valve can be obtained from the pair of toothed conductors. With an increase in the acceleration speed required, the frequency of the pulses generated increases.

Electric signals from the pair of toothed conductors are transmitted by way of a low-pass filter to a bistable multivibrator. High-frequency components which are noise are removed by the low-pass filter. If a phenomenon takes place where one toothed conductor alone is continuously grounded, rather than the pair of toothed conductors being alternately grounded, then the output of the bistable multivibrator remains independent of such phenomenon, and hence no improper influence are exerted on the succeeding processings.

The output of bistable multivibrator is transmitted to a monostable multivibrator, whereby a defect-free pulse is produced in response to the reversal of the electric conditions of the pair of toothed conductors.

Acceleration, injection valve electric signals are produced according to the output pulses of the bistable multivibrator.

The engine temperature is detected by detecting the temperature of the cooling water for the engine, and a logic electric signal dependent on the temperature of the cooling water for the engine is thus produced. The electric signal thus generated is multiplied by the output from the monostable multivibrator. The result is that the number of logic output pulses of the monostable multivibrator which are allowed to pass through the means for multiplying increases with the lowering of the temperature of the cooling water for the engine. Acceleration, injection valve electric signals are produced according to this multiplication. Preferably, the output of the monostable multivibrator is transmitted to a delay circuit. The output of the delay circuit is multiplied by the electric signal which varies according to the temperature of the cooling water for the engine, and the acceleration, injection valve electric signal is produced in response to the product thus obtained. The output of the delay circuit serves as a timing signal for the multiplication.

The electric signals obtained by multiplication of the output of the delay circuit by the electric signal which varies according to the temperature of the cooling water for the engine are triggered to form an acceleration injection valve pulse of a given pulse width. The acceleration, injection valve pulse thus generated is transmitted by way of an OR circuit to the injection valve. A pulse having a pulse width dependent on a flow rate of intake air is transmitted to the other input terminal of the OR circuit.

DESCRIPTION OF THE PREFERRED EMBODIMENTS

Figure 1:
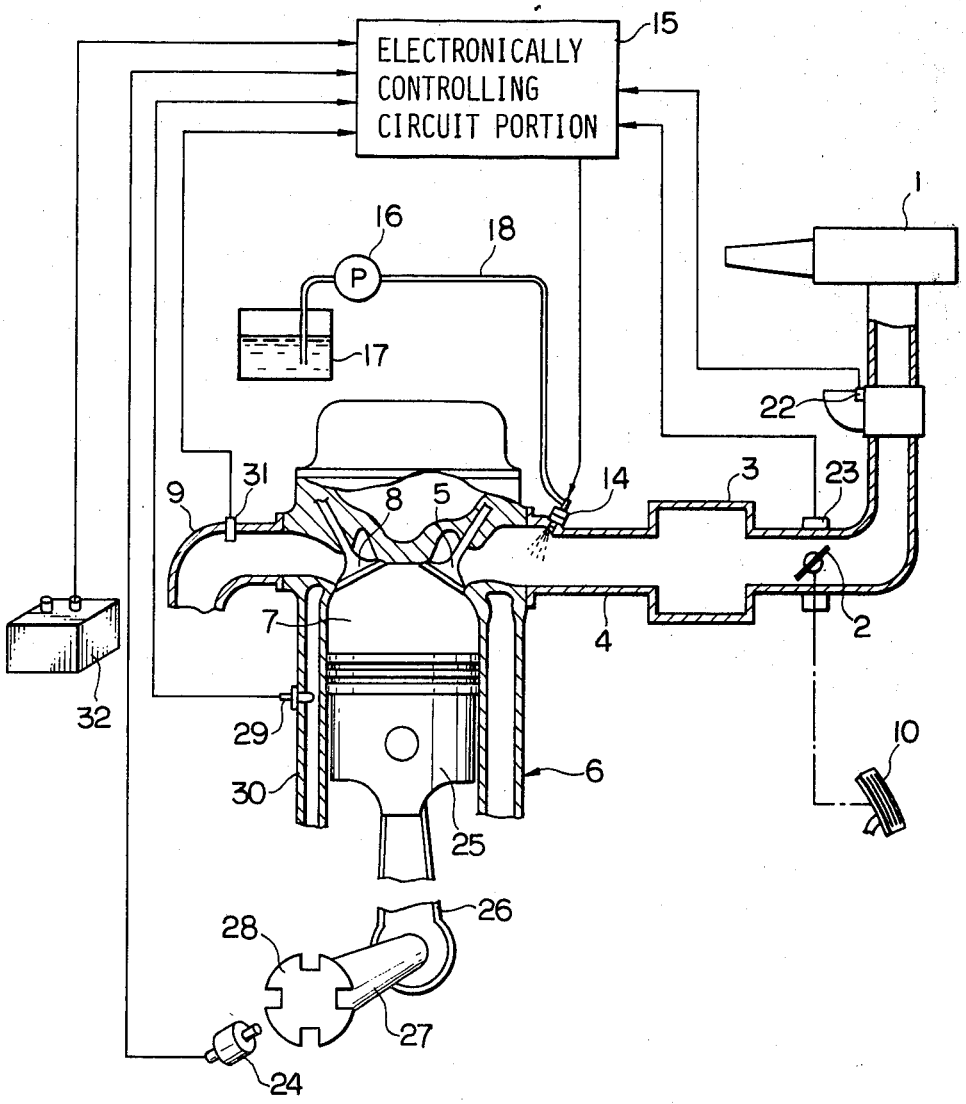
FIG. 1 is a schematic view of an electronically controlled fuel injection device embodying the method of the present invention.

FIG. 1 schematically shows an electronically controlled fuel injection device embodying the method of the present invention. Intake air is drawn under suction from an air cleaner 1 into an intake system. A flow rate of intake air is controlled by a throttle valve 2 interconnected to an acceleration pedal 10 provided in a driver's compartment. The intake air is then supplied by way of a surge tank 3, an intake manifold 4 and an intake valve 5 into a combustion chamber 7 of an engine body 6. The mixture charge burnt in the combustion chamber 7 is discharged in the form of exhaust gases from an exhaust manifold 9 by way of an exhaust valve 8. A fuel injection valve 14 is provided in the intake manifold 4, facing the respective combustion chamber. An opening duration and an opening time of the fuel injection valve 14 are controlled by electric signals from an electronic controlling circuit portion 15, so that the fuel injection valve may inject a fuel carried by a fuel pump 16 from a fuel tank 17 through a duct 18 into the intake system.

An air flow meter 22 detects a flow rate of intake air. A throttle sensor 23 detects a speed of the throttle valve moving to the open position. A crank-angle sensor 24 generates pulses in association with rotation of a disc 28 with circumferential cuts, which is mounted on a crank shaft 27 connected to the lower end of a connecting rod 26 coupled to a piston 25, in order to detect a crank angle of the crank shaft 27. A cooling-water temperature sensor 29 is attached to a water jacket 30 to detect a temperature of the cooling water. An exhaust-gas sensor 31 is attached to the exhaust manifold 9, to detect a concentration of oxygen in the exhaust gases. The outputs of the air flow meter 22, throttle sensor 23, crank-angle sensor 24, cooling-water temperature sensor 29 and exhaust-gas sensor 31 are transmitted to the electronic controlling circuit portion 15. Information relating to a voltage of a battery 32 is transmitted to the electronic controlling circuit 15.

Figure 2:
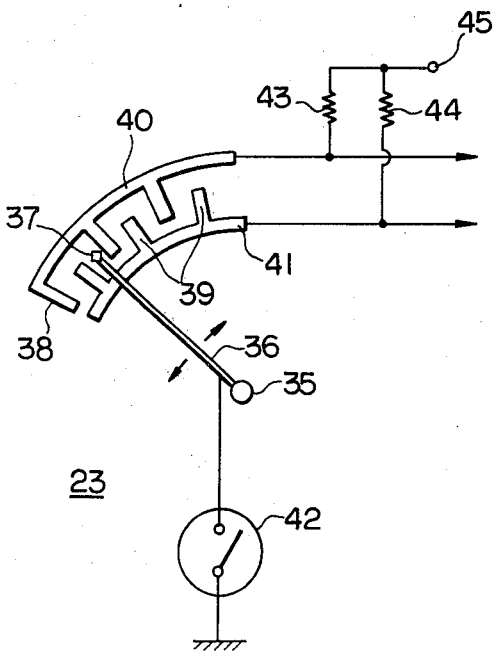
FIG. 2 is an enlarged view of a throttle sensor of FIG. 1.

FIG. 2 illustrates the throttle sensor 23 in detail. The throttle sensor 23 comprises; a conductor rod 36 rotating integrally with a shaft 35 of the throttle valve 2; conductors 40 and 41 respectively having equally spaced teeth 38 and 39 with the teeth of one conductor staggered with the teeth of the other conductor in a manner that a tip 37 of the conductor rod 36 contacts alternately the teeth of respective conductors, when the conductor rod 36 is turned; a switch 42 adapted to be turned on only when the throttle valve 2 is turned to the open position, thereby connecting the conductor rod 36 to ground. When the throttle valve 2 is turned to the close position, the switch 42 is turned off. Since the conductors 40 and 41 are connected by way of resistors 43 and 44, respectively, to a terminal 45 of a given positive voltage level, then pulses dependent on the speed of the throttle valve moving to the open position are obtained from the conductors 40 and 41.

Figure 3:
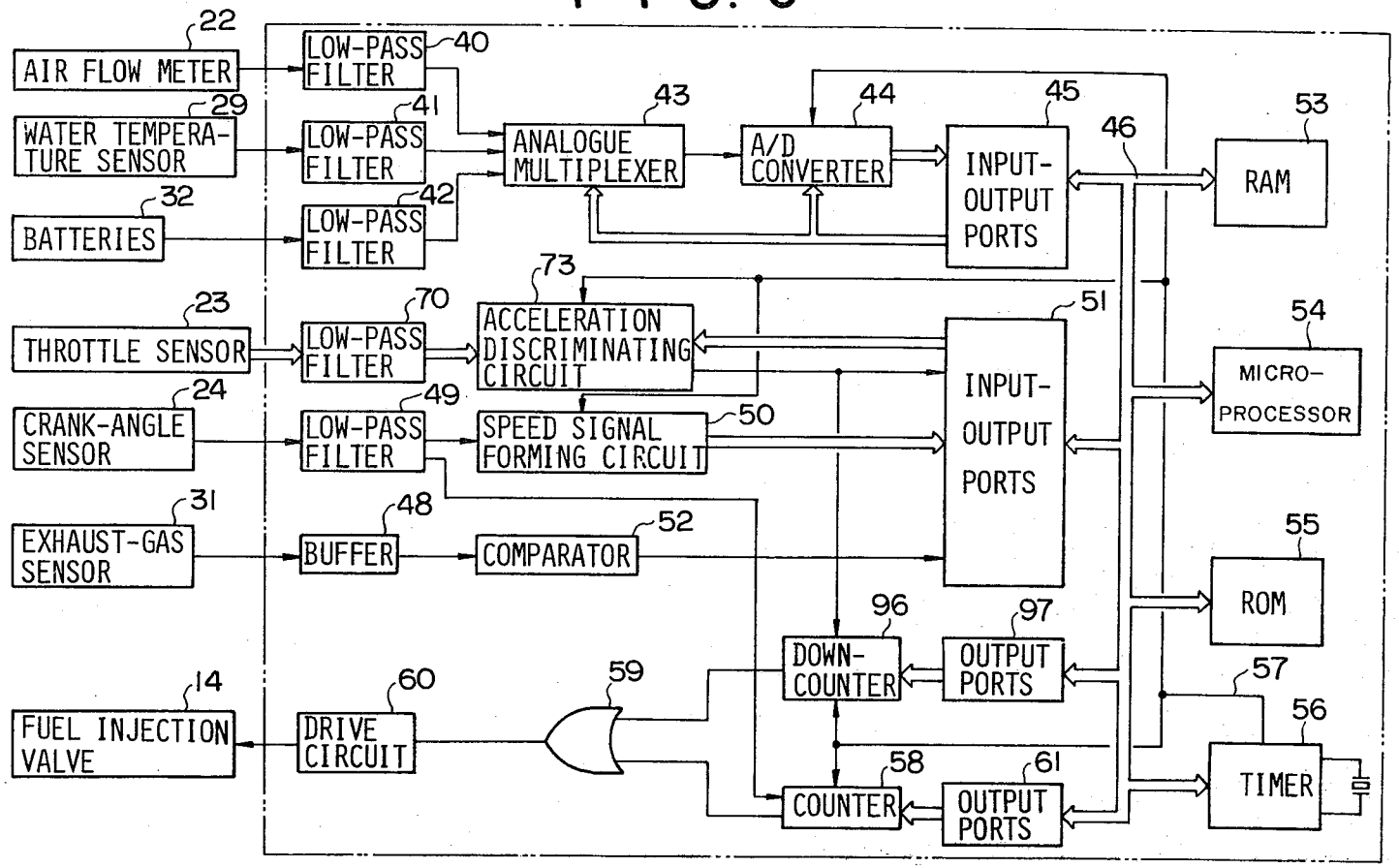
FIG. 3 is a block diagram of an electronic controlling circuit portion of FIG. 1.

FIG. 3 illustrates the electronic controlling circuit portion 15 in detail. The outputs of the air flow meter 22, water-temperature sensor 29 and battery 32 are transmitted by way of low-pass filters 40, 41 and 42 to an analogue multiplexer 43, and thence transmitted by the method of time division to an A/D converter 44, thereby being converted into digital signals. The output terminal of the A/D converter 44 is connected by way of input-output ports 45 to a bus 46. An output of the crank-angle sensor 24 is transmitted via a low-pass filter 49 to a speed signal forming circuit 50, the output terminal of which is connected by input-output ports 51 to the bus 46. An output of the exhaust-gas sensor 31 is transmitted via a buffer 48 to a comparator 52, for being shaped, and then transmitted to the input-output ports 51. A RAM 53, a CPU consisting of a micro-processor 54, a ROM 55 with incorporated programs and a timer 56 are connected to the bus 46. The micro-processor 54 determines $T=K\cdot(O/N)$ according to the program stored in the ROM 55, wherein T is representative of time; K, a compensation value dependent on a voltage of the battery 32 and a concentration of oxygen in the exhaust gases; Q, a flow rate of intake air; and N, the revolutions of the crank shaft per unit time. The micro-processor transmits an output signal representing the value T to output ports 61. The timer circuit 56 generates a synchronizing signal which is delivered by way of a clock line 57, and the value at output ports 61 is stored in a counter 58 in response to a predetermined synchronizing signal. The counter 58 which is triggered by a signal from the low pass filter 49 effects subtraction in response to the clock signal. The output of the counter 58 is maintained at "1" until the content of the counter 58 becomes zero. This "1" signal is transmitted by way of an OR circuit 59 and a drive circuit 60 to the injection valve 14, thereby maintaining the injection valve 14 at the open position.

Figure 4:
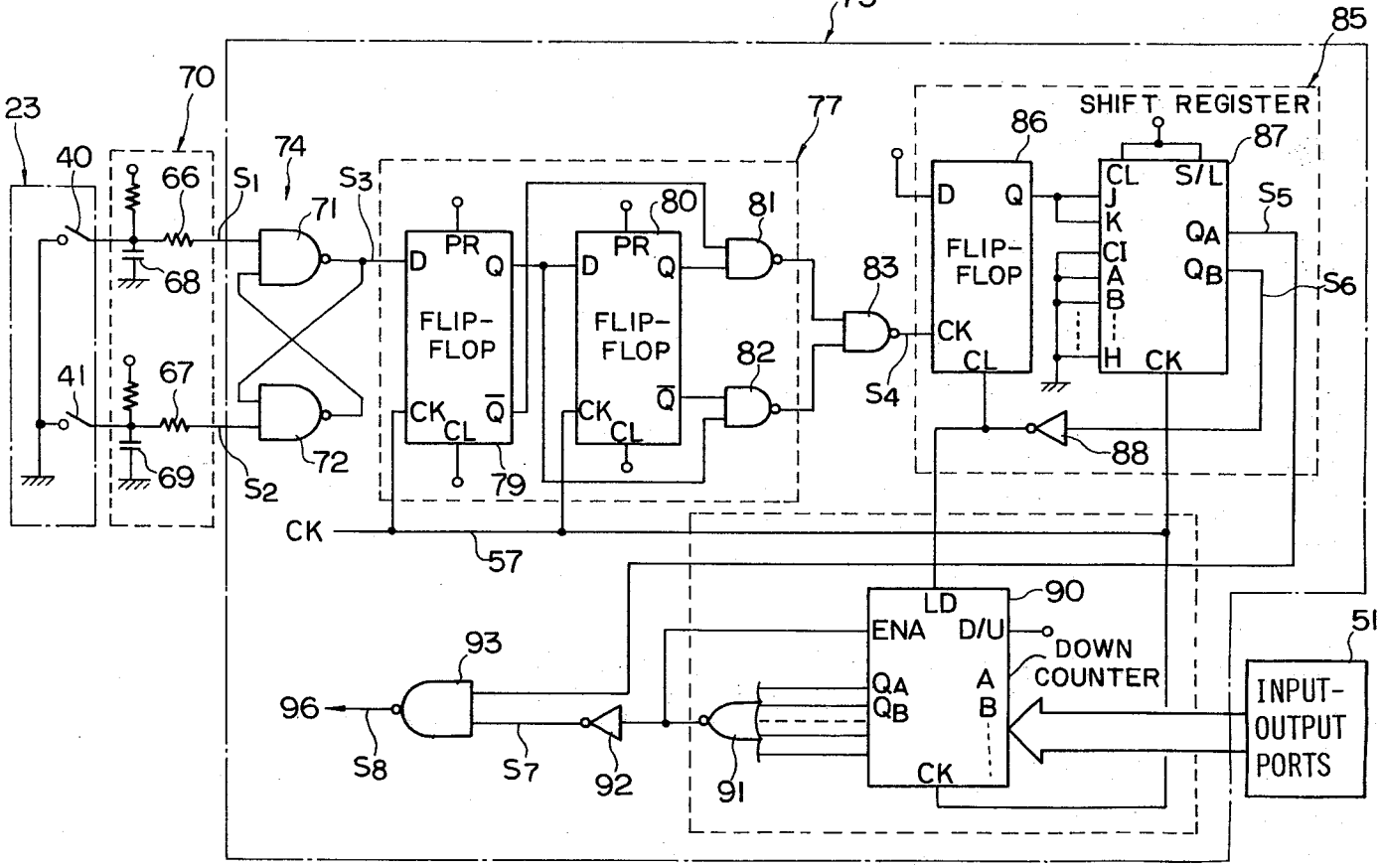
FIG. 4 is a block diagram of an acceleration discriminating circuit of FIG. 3.
Figure 5:
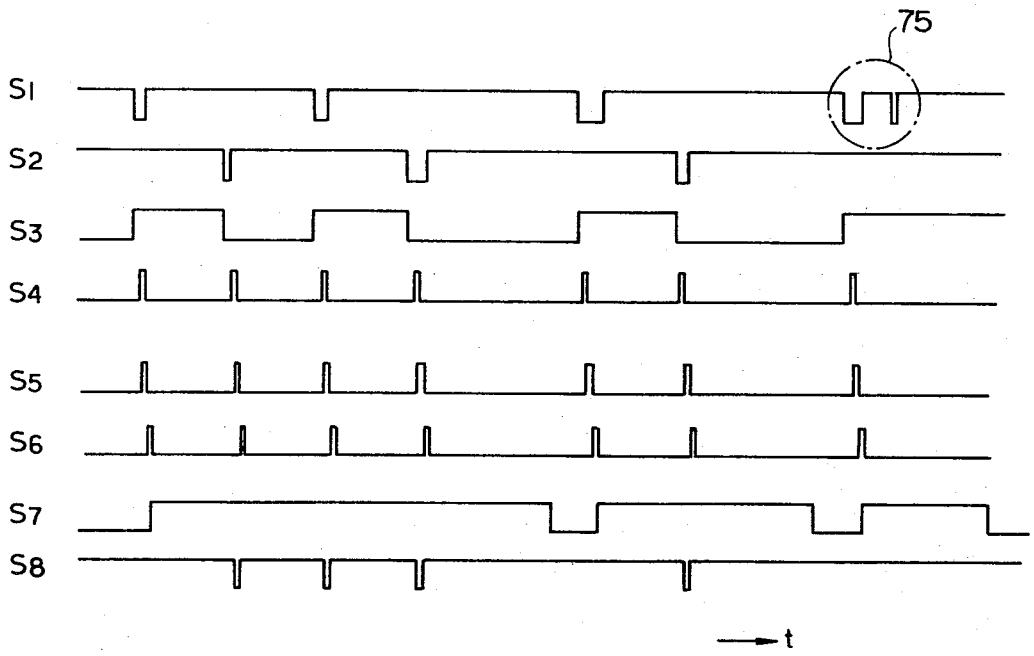
FIG. 5 shows voltage wave forms in respective portions of FIG. 4.

The processing of an output of the throttle sensor 23 will be described in detail with reference to a block diagram of a circuit of FIG. 4 and a timing chart of FIG. 5. In FIG. 5, a time t is expressed on a horizontal axis, and reference symbols in FIG. 5 correspond to the portions shown by the same reference symbols in FIG. 4. The outputs of the conductors 40 and 41 of the throttle sensor 23 are transmitted by way of a low-pass filter 70 including resistors 66,67 and capacitors 68,69 to a bistable multivibrator 74 consisting of two NAND circuits 71 and 72, of an acceleration discriminating circuit 73. The output S3 of the bistable multivibrator 74 is inverted from "0" to "1" (a low level voltage is hereinafter referred to as "0", and a high level voltage as "1".) at every trailing edge of an input S1, and inverted from "1" to "0" at every trailing edge of an input S2. Although the conductor 40 would be inverted to "0" continuously during the running of the engine in the acceleration mode, as shown in the portion 75 in FIG. 5, the bistable multivibrator 74 does not respond, on and after the second "0" of the inputs S1 and S2, thus preventing the influence on the second "0" from extending to succeeding stages. The output S3 of the bistable multivibrator 74 is transmitted to a monostable multivibrator 77. The monostable multivibrator 77 includes D-type flip-flops 79 and 80 in which logical values at the D-terminals are generated at Q-terminals at the leading edge of every input pulse at CK terminals, and NAND circuits 81 and 82. When the input S3 is inverted to "1" and a clock pulse is fed as an input to the CK terminal of flip-flop 79, then the output at the Q-terminal of the flip-flop 79 becomes "1". Thereafter, when a clock pulse is fed to the CK-terminal of the flip-flop 80, the output at the Q-terminal of the flip-flop 80 is inverted to "1". The output of the NAND circuit 81 is thus maintained at "0" from the trailing edge of the input S1 for an interval between clock pulses, and on the other hand, the output of the NAND circuit 82 is maintained at "0" from the leading edge of the input S1 for an interval between clock pulses. As a result, there is formed at the output terminal of the NAND circuit 83 a signal S4 having a pulse every time the input S3 of the monostable multivibrator 77 is inverted.

Figure 6:
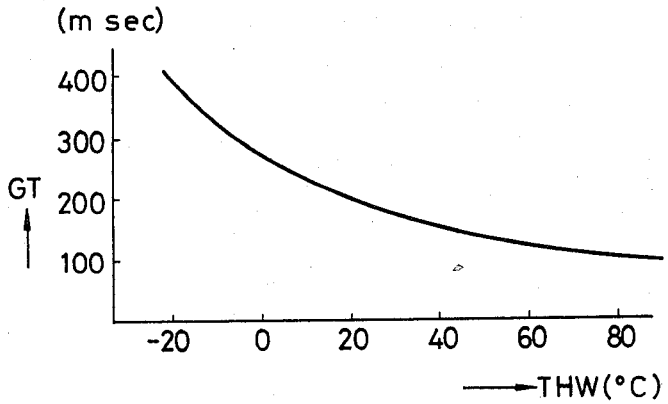
FIG. 6 is a graph representing the relationship of a gate timing in the NAND circuit of the acceleration discriminating circuit of FIG. 4 versus the temperature of the cooling water for the engine; and, FIG. 7 is a graph representing an acceleration fuel-injection region in a modified device embodying the method of the present invention.

The output S4 of the NAND circuit 83 is transmitted to a delay circuit 85. The delay circuit 85 includes a D-type flip-flop 86 as a preceding stage and a shift register 87 as a succeeding stage. Since the output at the D-terminal of the flip-flop 86 is usually "1", when the output at the CK-terminal of the flip-flop 86 is inverted from "0" to "1", the output at the Q-terminal of the flip-flop 86 becomes "1". Thereafter, when a clock pulse is provided to the CK-terminal of the shift register 87, the output at the QA-terminal of the shift register 87 is inverted to "1", and thereafter, when a clock pulse is provided to the CK-terminal of the shift register 87, the output at the QB-terminal thereof becomes "1". The output at the QB-terminal is transmitted via an inverter 88 to a CL-terminal of the flip-flop 86, and the output at the Q-terminal of the flip-flop 86 becomes "0". Thus, signals S5 and S6 which are shifted in phase from one another are formed at the QA-terminal and QB-terminal of the shift register 87 from the signal input to the delay circuit 85. The micro-processor 54 transmits to the input-output ports 51 bit signals relating to the information from the water-temperature sensor 29 and information obtained from the ROM 55. A down-counter 90 receives the input "0" at the LD-terminal thereof as well as the content of the input-output ports 51, and subtracts "1" every time a clock pulse is fed to the CK-terminal thereof. Since the outputs at the terminals QA, QB . . . of the down-counter 90 are fed to a NOR circuit 91, then the output at the NOR circuit 91 is maintained at "0" until the down-counter 90 becomes zero. The "0" output of the NOR circuit 91 is transmitted to an ENA (enable) terminal of the down-counter 90, thereby stopping the down-counter 90 and setting-up the down-counter 90 for reception of a succeeding input. The output of the NOR circuit 91 is transmitted via an inverter 92 to one input terminal of a NAND circuit 93. The gate time GT, or the duration which an output signal S5 of the inverter 92 is maintained at "1", and an engine-cooling-water temperature THW exhibit the relationship as shown in FIG. 6. From this, it is seen that, with the lowering of engine-cooling-water temperature, the number of pulses which are allowed to pass through the NAND circuit 93 increases. The output of the NAND circuit 93 is input to a down-counter 96 (FIG. 3). The down-counter 96 is triggered by the input from the NAND circuit 93 to be fed with the content of the output ports 97 and subtracts 1 every time a clock pulse is fed thereto, whereby there is formed a pulse having a pulse width corresponding to a duration which the content of the down-counter 96 becomes zero. The pulse thus formed is transmitted via the OR circuit 59 and the drive circuit 60 to the fuel injection valve 14, whereby fuel is injected from the fuel injection valve into the intake system. An amount of fuel being injected from the fuel injection valve 14 is thus controlled according to the acceleration required and the engine temperature.

Of the components used in the device emboying the method of the present invention, the D-type flip-flops, the shift register, and the down-counters are products of Texas Instruments Company, which are commercially availed as SN7474, SN74199 and SN84191, respectively.

As an alternative, such measures may be taken that an interval between pulses being produced from the throttle sensor 23 is measured by a time counter of either a hardware or a software type, and if the pulse interval measured is within a reference period of time (substantially equal to the gate time GT shown in FIG. 6) which is dependent on the engine-cooling-water temperature, then an injection signal is transmitted to the fuel injection valve 14.

Figure 7:
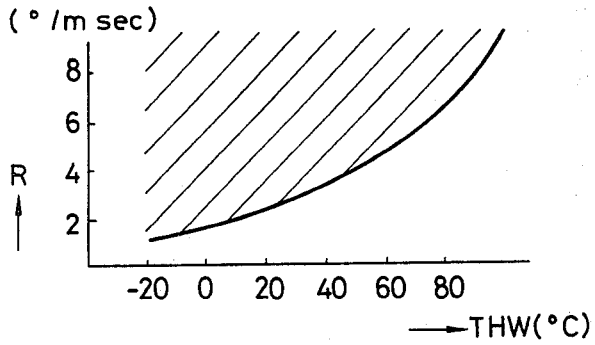

Another measure that may be taken uses a potentiometer for obtaining the opening of the throttle valve 2 in the form of a voltage signal; a variation in voltage is obtained by a proper hardware or a software routine; the varied voltage thus obtained is compared with a reference value determined by the engine-cooling-water temperature; when the varied voltage exceeds the reference value, fuel necessary for acceleration is injected from the injection valve 14. The mode of control in the latter method is shown in FIG. 7. In this graph, the abscissa expresses a temperature of the cooling water THW for an engine and the ordinate expresses a variation in opening in degrees per milisecond of the throttle valve. In the hatched region, the fuel needed for acceleration is supplied into the intake system.

What is claimed is:

1. An electronically controlled fuel injection method for an internal combustion engine, wherein a fuel injection valve for injecting fuel into an intake system is controlled by electric signals comprising the steps of:

generating an acceleration signal comprised of pulses in association with both a speed of movement of an acceleration pedal and an engine temperature; and transmitting to the fuel injection valve, asynchronously with the running of the engine, an increasing number of pulses for increasing a rate of fuel being injected from said fuel injection valve in response to at least one of the speed of movement of the acceleration pedal being increased and the engine temperature being lowered.

2. The method as defined in claim 1, further including the steps of generating a synchronous signal dependent on a flow rate of intake air and summing the acceleration signal and the synchronous signal for transmission to the fuel injection valve, the synchronous signal being transmitted synchronously with the running of the engine to the fuel injection valve.

3. The method as defined in claim 2, wherein said acceleration signal generating step includes the step of producing throttle signals representative of the variation in opening of the throttle valve in the intake system.

4. The method as defined in claim 3, wherein said producing step includes the step of sensing a variation in opening of the throttle valve with:

a pair of toothed conductors disposed with the teeth of one conductor staggered with and at a given spacing from the teeth of the other conductor, a contact portion adapted to move in contact with the teeth of said pair of toothed conductors in association with the movement of said throttle valve, and a switch adapted to connect said contact portion to a ground terminal only when the opening of said throttle valve is increased, the throttle signals produced in association with the variation in opening of the throttle valve being obtained from said pair of toothed conductors.

5. The method as defined in claim 4, wherein said acceleration signal generating step further includes the step of transmitting the throttle signals from said pair of toothed conductors to two input terminals of a bistable multivibrator.

6. The method as defined in claim 5, wherein said acceleration signal generating step further includes the step of filtering the throttle signals from said pair of toothed conductors via a low-pass filter before being input to the two input terminals of said bistable multivibrator.

7. The method as defined in claim 6, wherein said acceleration signal generating step further includes the step of inputting the output of said bistable multivibrator to a monostable multivibrator.

8. The method as defined in claim 7, wherein the acceleration signal generating step includes the step of generating electric pulses having a given pulse width and being available at the output of said monostable multivibrator.

9. The method as defined in claim 8, further including the step of producing a temperature signal representative of the temperature of the cooling water for the engine.

10. The method as defined in claim 9, wherein the step of generating the acceleration signal includes the step of multiplying the temperature signal dependent on the engine-cooling-water temperature by the output of said monostable multivibrator.

11. The method as defined in claim 10, wherein the step of generating the acceleration signal includes the steps of transmitting the output of said monostable multivibrator to a delay circuit, and multiplying the temperature signal dependent on the engine-cooling-water temperature by an output of said delay circuit.

12. The method as defined in claim 11, wherein the step of transmitting the acceleration signal obtained by the multiplication of the temperature signal dependent on the engine-cooling-water temperature by the output of said delay circuit includes the steps of using the acceleration signal as trigger pulses for forming acceleration injection valve pulses of a given width, and transmitting said acceleration injection valve pulses via an OR circuit to the fuel injection valve.

13. The method as defined in claim 12, wherein said summing step includes the step of transmitting the synchronous signal having a pulse width dependent on a flow rate of intake air via said OR circuit to the fuel injection valve.

14. The method as defined in claim 4, wherein the acceleration signal generating step further includes the steps of measuring an interval of inversion of an electric state of said pair of toothed conductors by a timer, and transmitting the acceleration signal, if the interval thus measured is within a reference period determined by the engine-cooling-water temperature, to the fuel injection valve.

15. The method as defined in claim 3, including the steps of comparing the throttle signals to a reference value determined according to the engine-cooling-water temperature, and transmitting the acceleration signal to the fuel injection valve in response to the throttle signal exceeding the reference value.

16. An apparatus for electronically controlling a fuel injection valve for injecting fuel into an intake system of an internal combustion engine, comprising:

means for producing throttle signals representative of the speed of movement of an acceleration pedal;

means for producing a temperature signal representative of the engine temperature;

means for generating an acceleration signal comprised of pulses related to both said throttle and temperature signals; and means for transmitting to the fuel injection valve, asynchronously with the running of the engine, an increasing number of pulses for increasing the rate of fuel being injected from said fuel injection valve in response to at least one of the speed of movement of the acceleration pedal being increased and the engine temperature being lowered.

17. The apparatus as defined in claim 16 further comprising:

means for generating a synchronous signal responsive to a flow rate of intake air; and means for summing the acceleration and synchronous signals for transmission to the fuel injection valve, said synchronous signal being transmitted synchronously to the fuel injection valve.

18. The apparatus as defined in claim 17 including a throttle valve in the intake system, and wherein the means for producing the throttle signals includes a sensor for sensing a variation in the opening of the throttle valve in the intake system.

19. The apparatus as defined in claim 18, wherein the sensor for sensing the variation in opening of the throttle valve comprises:

a pair of toothed conductors disposed wth the teeth of one conductor staggered with and at a given spacing from the teeth of the other conductor;

a contact portion adapted to move in contact with the teeth of said pair of toothed conductors in association with the movement of said throttle valve; and a switch adapted to connect said contact portion to a ground terminal only when the opening of said throttle valve is increased;

the throttle signals produced in association with the variation in opening of the throttle valve are obtained from said pair of toothed conductors.

20. The apparatus as defined in claim 19, including a bistable multivibrator, and wherein the throttle signals from said pair of toothed conductors are transmitted to two input terminals of said bistable multivibrator.

21. The apparatus as defined in claim 20, including a low pass filter, and wherein the throttle signals from said pair of toothed conductors are transmitted via said low-pass filter to the two input terminals of said bistable multivibrator.

22. The apparatus as defined in claim 21, including a monostable multivibrator, and wherein the output of said bistable multivibrator is transmitted to said monostable multivibrator.

23. The apparatus as defined in claim 22, wherein the throttle signals generated according to a speed of movement of an acceleration pedal are electric pulse signals having a given pulse width, said electric pulse signals being available at the output of said monostable multivibrator.

24. The apparatus as defined in claim 23, wherein the means for producing the temperature signal includes means for detecting the temperature of the cooling water for the engine.

25. The apparatus as defined in claim 24, wherein the means for generating the acceleration signal includes means for multiplying the temperature signal and the output of said monostable multivibrator.

26. The apparatus as defined in claim 25, including a delay circuit, and wherein an output of said monostable multivibrator is input to said delay circuit, and the acceleration signal is generated by multiplying the temperature signal and the output of said delay circuit.

27. The apparatus as defined in claim 26, including an OR circuit and wherein the acceleration signal obtained by multiplication of the temperature signal by the output of said delay circuit is used as a trigger pulse, for forming acceleration, injection valve pulses of a given width, said acceleration, injection valve pulses being transmitted via said OR circuit to the fuel injection valve.

28. The apparatus as defined in claim 27, wherein the synchronous signal is a pulse having a pulse width dependent on the flow rate of intake air and is transmitted via said OR circuit to the fuel injection valve.

29. The apparatus as defined in claim 19, including a timer, and wherein an interval of inversion of an electric state of said pair of toothed conductors is measured by said timer, and including a comparator such that when the interval thus measured is within a reference period determined by the engine-cooling-water temperature, the acceleration signal is transmitted to the fuel injection valve.

30. The apparatus as defined in claim 18, including a comparator such that when the throttle signals exceed a reference value determined according to the engine-cooling-water temperature the acceleration signal is transmitted to the fuel injection valve.

* * * * *